US009131755B1

(12) United States Patent
You

(10) Patent No.: US 9,131,755 B1
(45) Date of Patent: Sep. 15, 2015

(54) UMBRELLA WITH TELESCOPIC FRP SHANK

(71) Applicant: Ching-Chuan You, Taipei (TW)

(72) Inventor: Ching-Chuan You, Taipei (TW)

( * ) Notice: Subject to any disclaimer, the term of this patent is extended or adjusted under 35 U.S.C. 154(b) by 0 days.

(21) Appl. No.: 14/529,161

(22) Filed: Oct. 31, 2014

Related U.S. Application Data

(63) Continuation-in-part of application No. 14/178,296, filed on Feb. 12, 2014.

(30) Foreign Application Priority Data

Oct. 13, 2014 (CN) ..... 2014 2 0590527 U

(51) Int. Cl.
*A45B 25/16* (2006.01)
*A45B 19/04* (2006.01)
*A45B 25/14* (2006.01)

(52) U.S. Cl.
CPC ..... *A45B 25/16* (2013.01); *A45B 19/04* (2013.01); *A45B 25/143* (2013.01)

(58) Field of Classification Search
CPC ..... A45B 25/143; A45B 25/02; A45B 25/14; A45B 25/16; A45B 25/22; A45B 25/006; A45B 19/04
USPC ..... 135/22, 24, 25.1, 25.4, 20.3
See application file for complete search history.

(56) References Cited

U.S. PATENT DOCUMENTS

| | | | | | |
|---|---|---|---|---|---|
| 5,020,558 | A * | 6/1991 | Huang | 135/24 |
| 5,564,449 | A * | 10/1996 | Lin et al. | 135/24 |
| 5,645,094 | A * | 7/1997 | Wu | 135/24 |
| 5,791,359 | A * | 8/1998 | Lin et al. | 135/24 |
| 5,803,102 | A * | 9/1998 | Ko | 135/24 |
| 6,016,822 | A * | 1/2000 | Lin et al. | 135/24 |
| 6,112,755 | A * | 9/2000 | Lin et al. | 135/24 |
| 6,170,498 | B1 * | 1/2001 | Wu | 135/24 |
| 6,338,353 | B1 * | 1/2002 | Chen | 135/20.3 |
| 6,866,053 | B2 | 3/2005 | You | |
| 8,365,747 | B1 * | 2/2013 | Su | 135/24 |
| 2005/0257817 | A1 * | 11/2005 | Kuo | 135/24 |

* cited by examiner

*Primary Examiner* — Winnie Yip

(57) ABSTRACT

An umbrella shank is provided with a fiberglass-reinforced plastic (FRP) inner tube (10); an FRP outer tube (20); a spring biased moving mechanism (30) including a three-step diameter upper member (31) having a longitudinal groove (315), and a three-step diameter lower member (32) wherein the lower member (32) is inserted into the inner tube (10), the upper member (31) is complementarily disposed in the lower member (32), and the lower member (32) is in the outer tube (20); a fixing mechanism (40) in an upper portion of the outer tube (20); and a linking mechanism (60) in the outer tube (20) and including a rod (62) secured between the fixing mechanism (40) and a lower part (313) of the upper member (31), and a spring (65) put on the rod (62) and biased between the fixing mechanism (40) and tops of the upper member (31) and the lower member (32).

14 Claims, 12 Drawing Sheets

UMBRELLA WITH TELESCOPIC FRP SHANK

CROSS-REFERENCE TO RELATED APPLICATIONS

This application is a continuation in part of U.S. patent application Ser. No. 14/178,296 entitled "UMBRELLA HAVING TELESCOPIC FRP SHANK" filed Feb. 12, 2014 which is incorporated by reference for all purposes, and is now pending.

BACKGROUND OF THE INVENTION

1. Field of the Invention

The invention relates to umbrella frame and more particularly to a telescopic shank of a collapsible umbrella, the shank being made of fiberglass-reinforced plastic (FRP) having advantages including insulation, being rust proof, weight, smooth opening and closing operations, and prolonged useful life.

2. Description of Related Art

Umbrellas are personal articles. An umbrella can be collapsible or non-folding. An umbrella typically includes a shank, a rib assembly, and a canopy secured onto the rib assembly. A collapsible umbrella includes a folding rib assembly and a telescopic shank. A non-folding umbrella has a shank of fixed length. Shank of an umbrella can be made of metal or fiberglass-reinforced plastic (FRP). Shank of a collapsible umbrella comprises an outer tube, an inner tube, and a moving mechanism mounted in the inner tube. Typically, the inner tubes of small umbrellas are made of metal. Large umbrellas (e.g., golf umbrellas) have a shank of greater diameter, and a large rib and stretcher assembly. Thus, they are heavy. It is labor consuming for a user carrying a large umbrella for a long distance walk. Therefore, both the inner tube and the outer tube of a shank of a large umbrella (e.g., golf umbrella) are made of FRP.

U.S. Pat. No. 6,866,053 entitled "Beach Umbrella Having Telescopic Shank" discloses a telescopic shank made of FRP wherein both the inner tube and the outer tube have eccentric section so that they can be fastened together. However, its manufacturing is difficult because eccentric tubes cannot be easily molded due to different wall thicknesses. Further, fibers are not uniform in length. Furthermore, polymers of FRP are not uniformly mixed in the manufacturing process. Thus, precision of both the inner tube and the outer tube is poor and tolerances are large. As a result, both the inner tube and the outer tube tend to malfunction after a time of use.

Further, metal shank can be machined but FRP shank cannot be machined. Thus, positioning of the inner tube and the outer tube and positioning of the inner tube and the moving mechanism are impossible for FRP shank. Therefore, no disclosure of telescopic FRP shank of an umbrella is available. To the contrary, improvements with respect to weigh reduction of a large umbrella are made continuously. As a result, length reduction of an umbrella shank made of FRP is not possible as the present inventor is aware.

For reducing weight of umbrella shank, using aluminum alloy or other light metal materials as raw material for manufacturing umbrellas is possible. However, its manufacturing cost is several times of that of FRP frame. That is, its market survivability is low due to competitiveness. Thus, how to devise a light umbrella having a telescopic shank without the drawbacks of large umbrellas is always desirable among manufacturers in the art.

Typically, a type of large umbrella has all components made of FRP except the spring. However, actions between the inner tube and the moving mechanism are not smooth. To the contrast, most components of small umbrellas are made by machining thin metal blanks. Small umbrellas thus have drawbacks of being weak, being susceptible to being damaged by strong winds, susceptible to being rusted, and being susceptible to being injured by thunder.

The invention discussed below aims at providing a collapsible umbrella with a telescopic shank made of FRP having advantages including insulation, being rust proof, and light weight, thereby eliminating all drawbacks associated with conventional large umbrellas.

SUMMARY OF THE INVENTION

It is therefore one object of the invention to provide a telescopic FRP shank of an umbrella, with improvements including insulation, being rust proof, light weight, and generous clearances between moving components without sacrificing reliable operation, weight reduction, durability, and competitiveness.

For achieving above and other objects, the invention provides an umbrella shank comprising an inner tube formed of fiberglass-reinforced plastic (FRP) and including an interior; an outer tube formed of FRP and including an interior having a polygonal section and an inner diameter greater than an outer diameter of the inner tube so that the inner tube is configured to insert into the interior of the outer tube; a moving mechanism including an upper member formed of FRP, and a lower member formed of metal wherein the upper member is a three-step diameter component and includes an upper part, an intermediate part, and a lower part; a longitudinal groove is formed through outer surfaces of the upper, intermediate, and the lower parts, and; the lower member is a three-step diameter component and includes an upper part, an intermediate part, and a lower part; the upper part is a polygon, the intermediate part is a polygon, and the lower part is a cylinder; the upper part is a hollow polygon; the intermediate part is a hollow polygon; and the lower part is a hollow cylinder; the upper part is complementary to a polygonal interior of the upper part in shape, and the intermediate part is complementary to a polygonal interior of the intermediate part in shape; the lower part is complementarily inserted into the lower part, the lower part is inserted into the interior of the inner tube, and the upper member is partially disposed in the lower member with both the upper part and the upper part disposed above the inner tube and in the outer tube; a fixing mechanism disposed in an upper portion of the outer tube; and a linking mechanism disposed in the outer tube and including a rod and a spring member wherein the rod has a top end secured to the fixing mechanism and a bottom end passing through the longitudinal groove to secure to a bottom of the lower part; and the spring member is put on the rod and is biased between the fixing mechanism and tops of both the upper member and the lower member.

Preferably, the lower member is formed of metal such as iron, steel, aluminum, aluminum alloy, or similar metal material.

Preferably, there is further comprised of an aperture formed on an upper portion of the inner tube, a transverse aperture formed through the lower part, and a transverse aperture formed through the lower part.

Preferably, the interior has a section of hexagon, the upper part of the upper member has a hexagonal section, the intermediate part has a hexagonal section, the lower part is a cylinder, a diameter of the upper part is greater than that of the intermediate part, a diameter of the intermediate part is greater than that of the lower member, the interior in the upper part of the lower member has a hexagonal section, the interior of the intermediate part has a hexagonal section, the lower part is a cylinder, a diameter of the upper part is greater than that of the intermediate part, and a diameter of the intermediate part is greater than that of the lower part.

Preferably, each of the upper member and the fixing mechanism are formed of fiberglass-reinforced plastic (FRP).

For achieving above and other objects, the invention further provides an umbrella shank comprising an inner tube formed of fiberglass-reinforced plastic (FRP) and including an interior; an outer tube formed of FRP and including an interior having a polygonal section and an inner diameter greater than an outer diameter of the inner tube so that the inner tube is configured to insert into the interior of the outer tube; a moving mechanism including an upper member formed of FRP, and a lower member formed of metal wherein the upper member is a two-step diameter component and includes an upper part and a lower part; a longitudinal groove is formed through outer surfaces of the upper and lower parts and; the lower member is a two-step diameter component and includes an upper part and a lower part; the upper part is a polygon and the lower part is a cylinder; the upper part is a hollow polygon and the lower part is a hollow cylinder; the upper part is complementary to a polygonal interior of the upper part in shape; the lower part is complementarily inserted into the lower part, the lower part is inserted into the interior of the inner tube, and the upper member is partially disposed in the lower member with both the upper part and the upper part disposed above the inner tube and in the outer tube; a fixing mechanism disposed in an upper portion of the outer tube; and a linking mechanism disposed in the outer tube and including a rod and a spring member wherein the rod has a top end secured to the fixing mechanism and a bottom end passing through the longitudinal groove to secure to a bottom of the lower part; and the spring member is put on the rod and is biased between the fixing mechanism and tops of both the upper member and the lower member.

Preferably, the lower member is formed of metal such as iron, steel, aluminum, aluminum alloy, or similar metal material.

Preferably, there is further comprised of an aperture formed on an upper portion of the inner tube, a transverse aperture formed through the lower part, and a transverse aperture formed through the lower part.

Preferably, the upper part of the upper member has a hexagonal section, the lower part is a cylinder, a diameter of the upper part is greater than that of the lower part, the interior in the upper part of the lower member has a hexagonal section, the interior of the intermediate part has a hexagonal section, the lower part is a cylinder, and a diameter of the upper part is greater than that of the lower part.

Preferably, each of the upper member and the fixing mechanism are formed of fiberglass-reinforced plastic (FRP).

The invention has the advantages including insulation, being rust proof, light weight, smooth opening and closing operations, and prolonged useful life.

The above and other objects, features and advantages of the invention will become apparent from the following detailed description taken with the accompanying drawings.

DETAILED DESCRIPTION OF THE INVENTION

Figure 1:
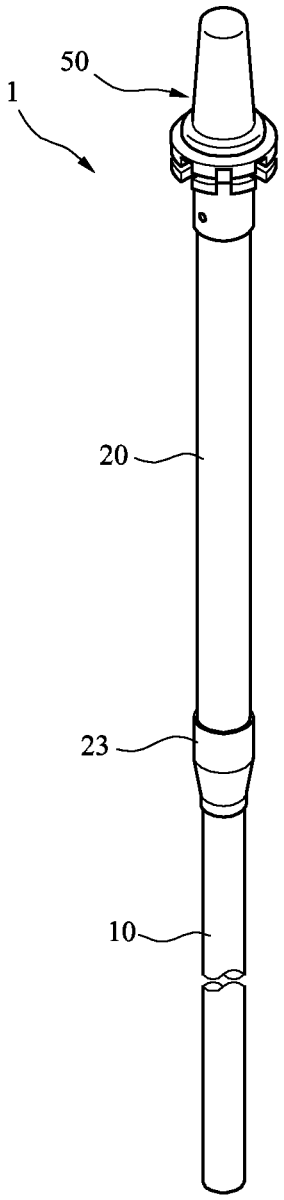
FIG. 1 is a perspective view of a shank and a thimble of a collapsible umbrella according to a first preferred embodiment of the invention.
Figure 2:
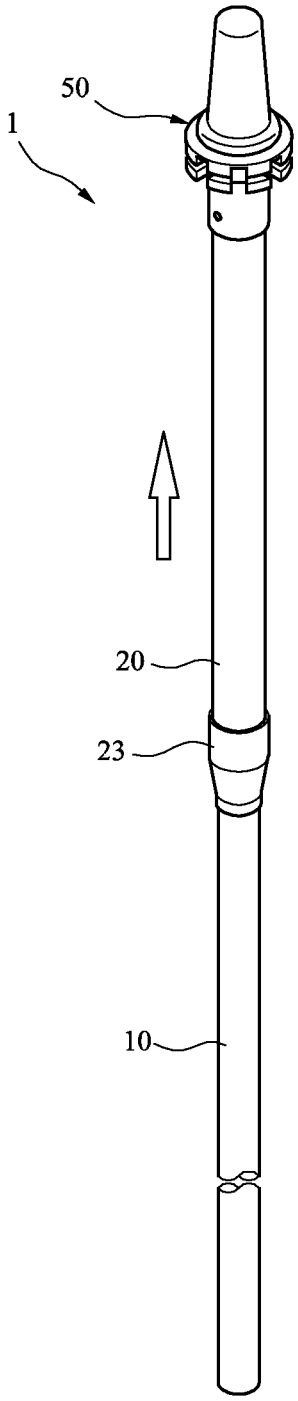
FIG. 2 is a view similar to FIG. 1 showing an extension of the shank.
Figure 3:
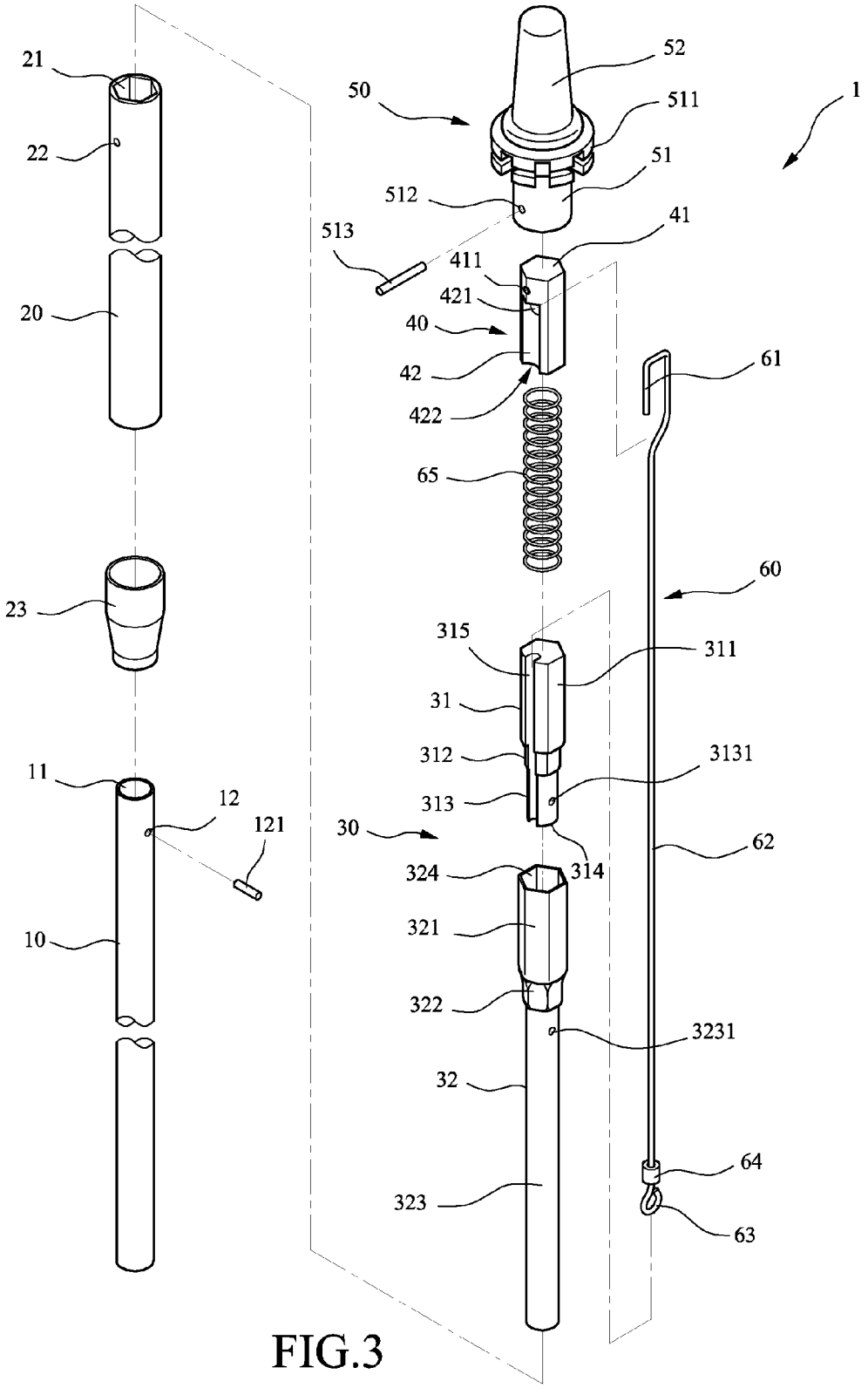
FIG. 3 is an exploded view of FIG. 1.

Referring to FIGS. 1 to 9, frame of a collapsible FRP umbrella 1 in accordance with a first preferred embodiment of the invention is shown. A shank of the frame comprises an inner tube 10, an outer tube 20, a moving mechanism 30, and a linking mechanism 60 as discussed in detail below.

The inner tube 10 has an interior 11 and is made of FRP. An aperture 12 is formed on an upper portion of the inner tube 10 (see FIG. 3). The outer tube 20 has an interior 21 and has a section of polygon, for example, hexagon. It is noted that other sections such as circular are possible in other embodiments. The outer tube 20 is also made of FRP. An aperture 22 is formed on an upper portion of the outer tube 20.

An outer diameter of the inner tube 10 is less than an inner diameter of the interior 21 so that the inner tube 10 can be inserted into the outer tube 20. In the embodiment, a sleeve 23 is provided on a bottom of the outer tube 20 and is shaped as funnel (i.e., having a wide upper portion and a narrow lower portion). An upper portion of the inner tube 10 is inserted into a lower portion of the outer tube 20 is fastened by the sleeve 23 (see FIG. 4).

The elongated moving mechanism 30 comprises an upper member 31 and a lower member 32. The upper member 31 is a three-step diameter component and comprises an upper part 311, an intermediate part 312, and a lower part 313. The lower part 313 is cylindrical. Diameter of the upper part 311 is greater than that of the intermediate part 312 and diameter of the intermediate part 312 is greater than that of the lower part 313. A longitudinal groove 315 is formed through outer surfaces of the upper, intermediate, and the lower parts 311, 312, and 313. A transverse aperture 3131 is formed through the lower part 313.

The lower member 32 is also a three-step diameter component and comprises an upper part 321, an intermediate part 322, and a lower part 323. Diameter of the upper part 321 is greater than that of the intermediate part 322 and diameter of the intermediate part 322 is greater than that of the lower part 323. An interior 324 is formed in the upper part 321 and has a section of polygon, for example, hexagon. The intermediate part 322 also has a polygonal interior such as one having a hexagonal section. The lower part 323 is cylindrical. A transverse aperture 3231 is formed through the lower part 323. The upper part 311 is complimentary to the interior 324 of the upper part 321 of the lower member 32 in shape. For example, the upper part 311 has a hexagonal section. The upper part 311 may be cylindrical in other embodiments. The intermediate part 312 is complimentary to an interior (not shown) of the intermediate part 322 of the lower member 32 in shape. For example, the intermediate part 312 has a hexagonal section. The intermediate part 312 may be cylindrical in other embodiments.

In assembly, the lower part 313 of the upper member 31 is inserted into the interior (not shown) of the lower part 323 of the lower member 32. Next, the lower part 323 of the lower member 32 is inserted into the interior 11 of the inner tube 10. A pin 121 is inserted through the aperture 12 into the aperture 3231 of the lower part 323 and the aperture 3131 of the lower part 313 to fasten the lower member 32 and the upper member 31 of the moving mechanism 30 and the inner tube 10 together. The bottom of the upper part 311 of the upper member 31 is urged against a top of the intermediate part 322 of the lower member 32, and a bottom of the intermediate part 312 of the upper member 31 is urged against a top of the lower part 323 of the lower member 32. Thus, the upper member 31 is partially disposed in an upper portion of the lower member 32 with a bottom of the intermediate part 322 of the lower member 32 urging against a top of the inner tube 10. The upper part 321 and the intermediate part 322 of the lower member 32 are concealed by the upper part 311 and the intermediate part 312 of the upper member 31 respectively. The upper part 321 and the intermediate part 322 of the lower member 32 are disposed above the inner tube 10. Both the upper and lower member 31, 32 are disposed in the interior 21 of the outer tube 20. The lower part 323 of the lower member 32 is inserted into the interior 11 of the inner tube 10.

An elongated fixing mechanism 40 is provided in the interior 21 of the outer tube 20. The fixing mechanism 40 is complementary to the interior 21 in shape. For example, the fixing mechanism 40 has a hexagonal section. The fixing mechanism 40 comprises an upper portion 41 and a lower portion 42. A transverse hole 411 is formed through the upper portion 41. A transverse hole 421 is formed through the lower portion 42 adjacent to a joining portion of the upper and lower portions 41, 42. Two opposite longitudinal troughs 422 are formed on an outer surface of the lower portion 42. The troughs 422 communicate with the transverse hole 421 (see FIG. 8).

Figure 4:
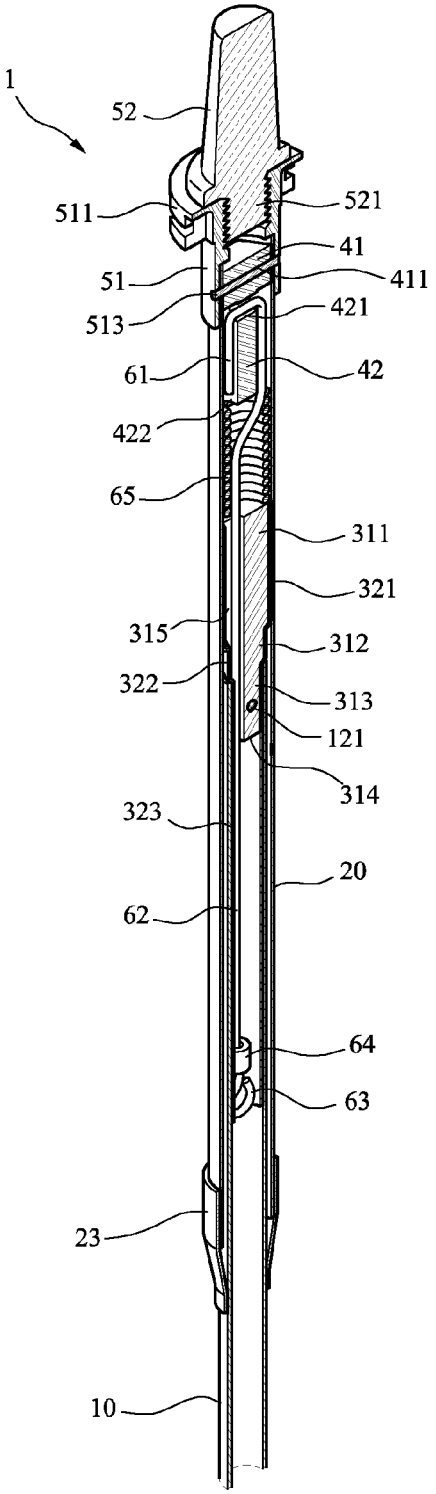
FIG. 4 is a longitudinal sectional view of FIG. 1.
Figure 5:
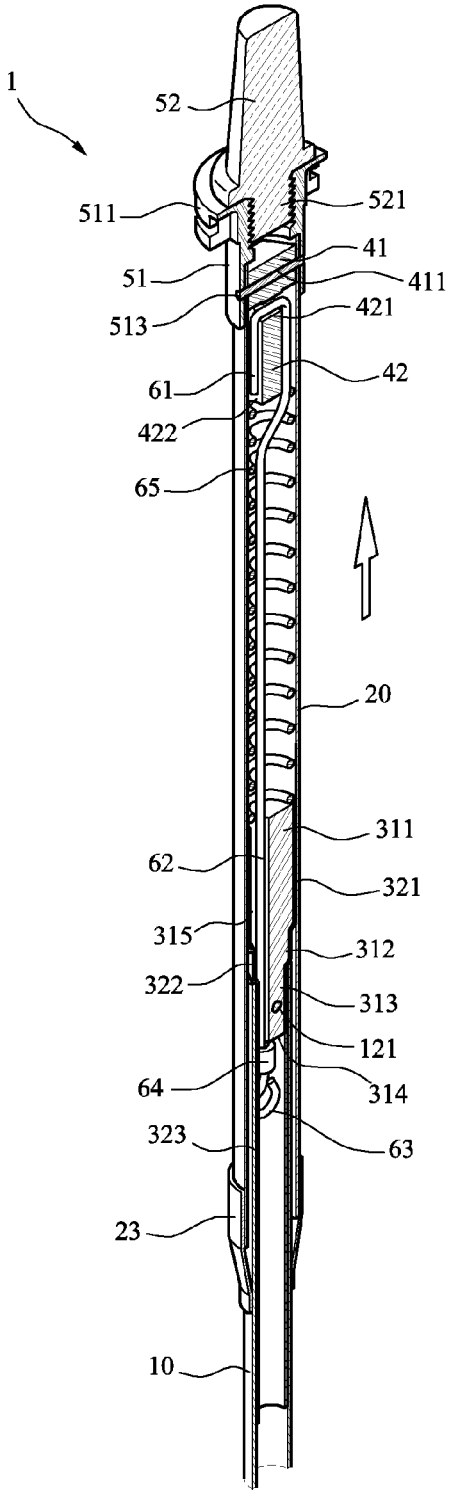
FIG. 5 is a longitudinal sectional view of FIG. 2.

A thimble 50 is provided on a top of the outer tube 20 and comprises a lower pitted cap 51 and an upper extension 52 having an externally threaded lower projection 521 secured to a pitted top of the cap 51 (see FIGS. 4 and 5). A grommet 511 is formed between the cap 51 and extension 52. A transverse hole 512 is formed through the cap 51. In the embodiment, a pin 513 is inserted through the hole 512, the aperture 22, and the hole 411 to fasten the thimble 50, the outer tube 20, and the fixing mechanism 40 together at a top of the umbrellas 1. The outer tube 20, the upper member 31 of the moving mechanism 30, and the fixing mechanism 40 are formed of FRP. The lower member 32 of the moving mechanism 30 is formed of metal such as iron, steel, aluminum, aluminum alloy, or similar metal material.

The linking mechanism 60 is disposed in the outer tuber 20 and comprises an elongated rod 62 and a compression spring 65. The elongated rod 62 is formed of metal or steel and has a top end shaped as an inverted U-shaped hook 61, and a bottom end shaped as a C-shaped hook 63. A hollow, cylindrical buffer member 64 is put on a portion of the rod 62 proximate to the hook 63. The hook 61 is inserted through the hole 421 and is engaged with the troughs 422 in order to secure the linking mechanism 60 and the fixing mechanism 40 together (see FIG. 8). The rod 62 is partially inserted into the longitudinal groove 315 through the upper part 311, the intermediate part 312, and the lower part 313 of the upper member 31 until the hook 63 extends out of the upper member 31 to dispose in the lower part 323 of the lower member 32 proximate to the sleeve 23 (see FIGS. 4, 5, and 9). Bottom 314 of the lower part 313 of the upper member 31 is urged against the buffer member 64 when the umbrella 1 is fully opened so that the lower part 313 can be prevented from being damaged. The spring 65 is put on the rod 62 and is biased between the fixing mechanism 40 and tops of both the upper part 311 of the upper member 31 and the upper part 321 of the lower member 32. Thus, the upper member 31, i.e., the moving mechanism 30, is a spring biased member.

Figure 6:
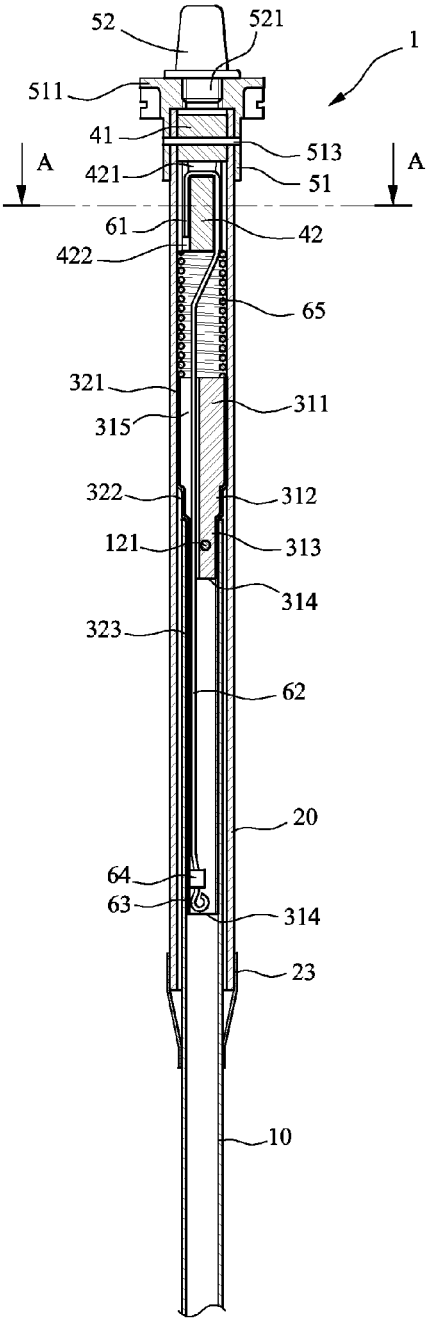
FIG. 6 is a side elevation of FIG. 4.
Figure 7:
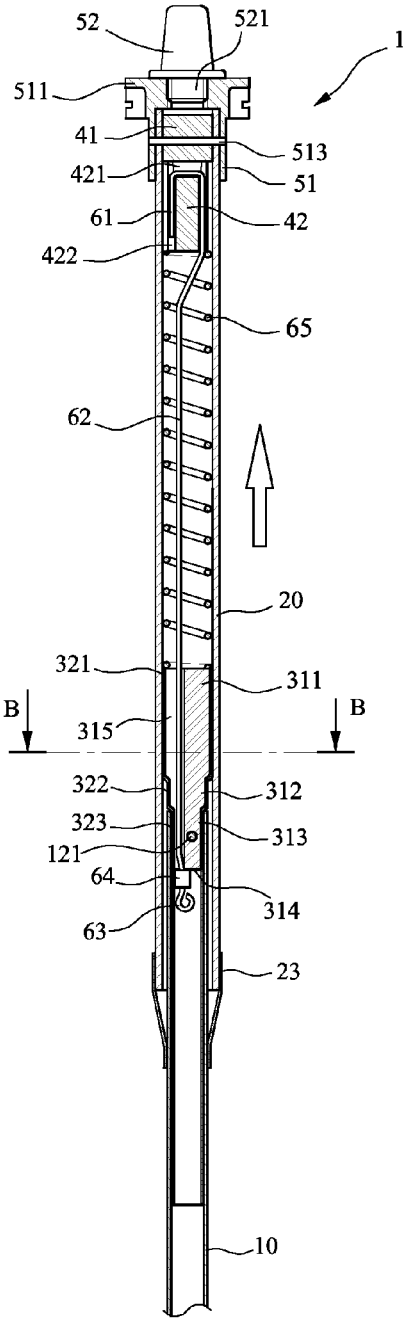
FIG. 7 is a side elevation of FIG. 5.
Figure 8:
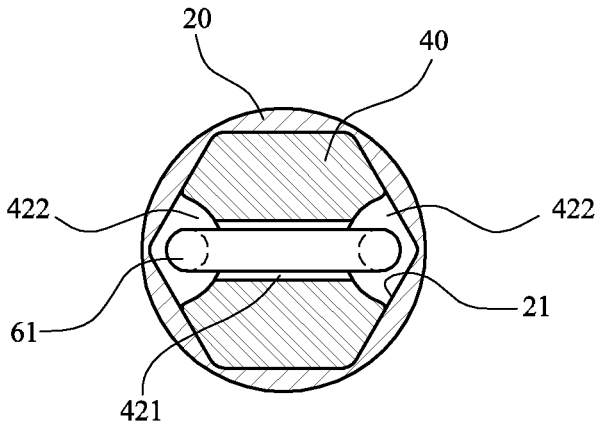
FIG. 8 is a sectional view taken along lines A-A of FIG. 6.

As shown in FIGS. 5 to 7, in an operation of closing the umbrella 1, the inner tube 10 is pushed upward and the moving mechanism 30 also moves upward because the pin 121 is inserted through the aperture 12 into the aperture 3231 of the lower part 323 and the aperture 3131 of the lower part 313 to fasten the lower member 32 and the upper member 31 of the moving mechanism 30 and the inner tube 10 together. The spring 65 is compressed by both the upper part 311 of the upper member 31 and the upper part 321 of the lower member 32. Thus, an upper portion of the inner tube 10 is retracted into the outer tube 20 (see FIG. 6).

To the contrary, in an operation of opening the umbrella 1, an individual may hold a handle connected to a lower end of the inner tube 10 and pull down the inner tube 10. As a result, the inner tube 10 extends out of the outer tube 20 with the expansion of the energized spring 65 (see FIGS. 2, 5, and 7). The opening of the umbrella 1 can be facilitated by installing a runner and a locking device (detailed later) on the inner tube 10 so that the umbrella 1 may have an automatic opening mechanism.

Figure 9:
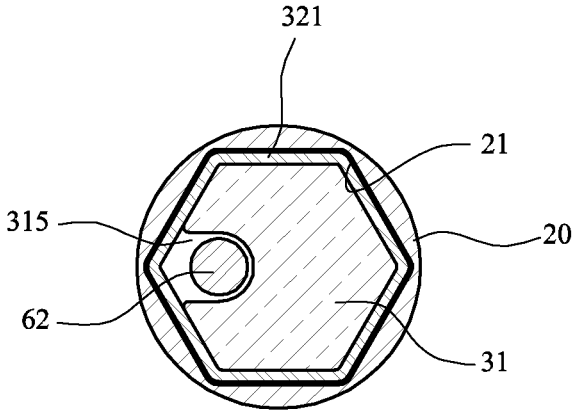
FIG. 9 is a sectional view taken along lines B-B of FIG. 7.

The upper member 31 is disposed in the lower member 32 made of metal. As shown in FIG. 9, the complimentary engagements of the upper part 311 of the upper member 31 and the upper part 321 of the lower member 32 in the interior 21 of the outer tube 20 ensures a smooth operation of both the upper member 31 and the lower member 32. Further, the inner tube 10 is prevented from rotating in the opening or closing operation. Also, the complimentary engagement of the fixing mechanism 40 in the interior 21 of the outer tube 20 ensures a smooth operation of the fixing mechanism 40 by the rod 62. Furthermore, operation of the inner tube 10 is more smooth.

The upper member 31 made of FRP is disposed in the lower member 32 made of metal. The lower part 323 of the lower member 32 is disposed in the inner tube 10 made of FRP. Thus, both the upper member 31 and the inner tube 10 are structurally strong enough to withstand force exerted by both the spring 65 and a compression spring 74 (see FIG. 10). These innovative improvements can make operation more smooth and reliable, and prolong a useful life for any small or large type of the umbrella.

Figure 10:
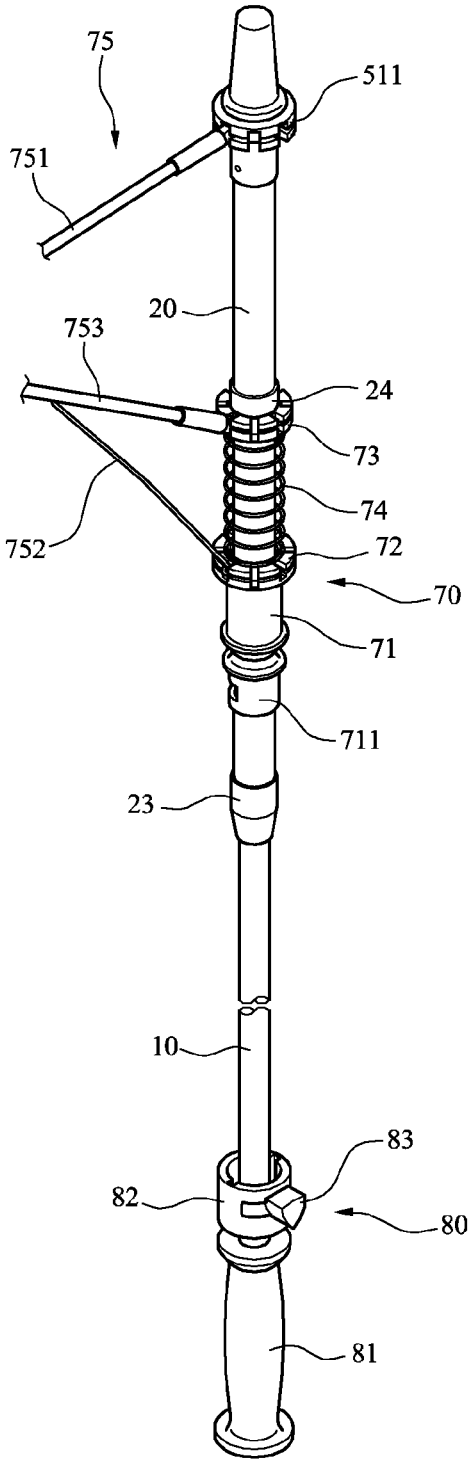
FIG. 10 is a perspective view of a portion of a frame of an automatically opened umbrella incorporating the first preferred embodiment of the invention.
Figure 11:
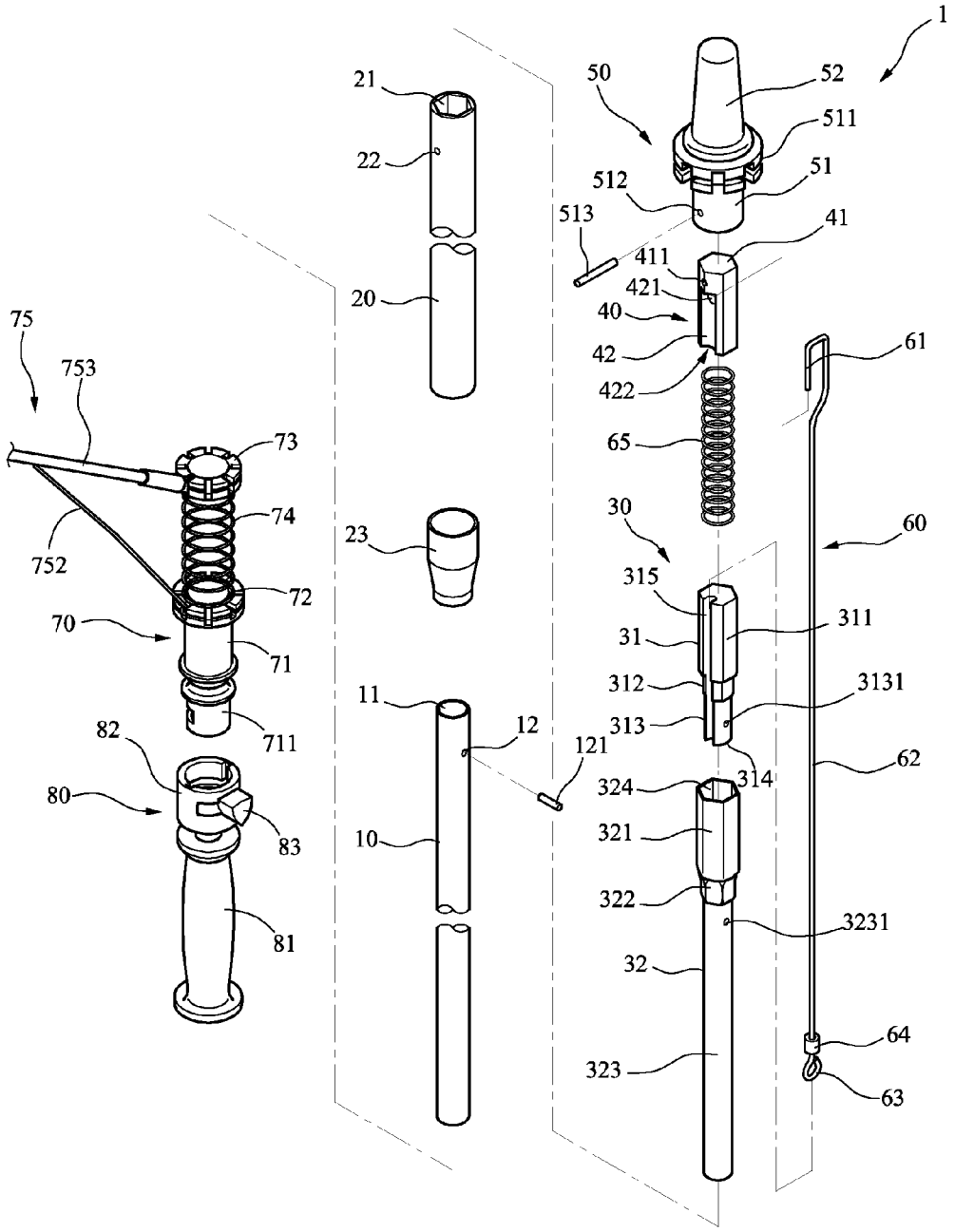
FIG. 11 is an exploded view of FIG. 10.
Figure 12:
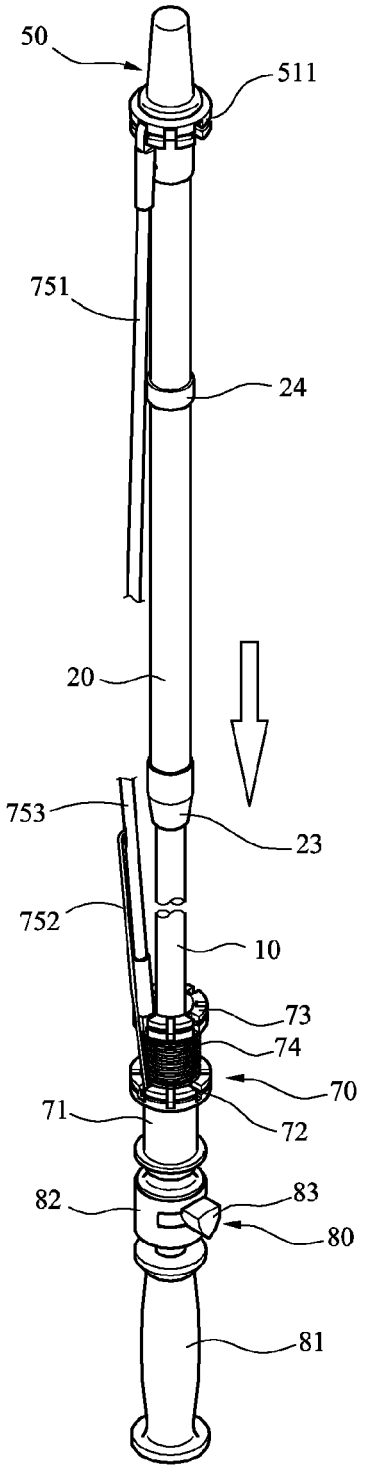
FIG. 12 is a view similar to FIG. 10 showing a closing operation of the automatically opened umbrella.
Figure 13:
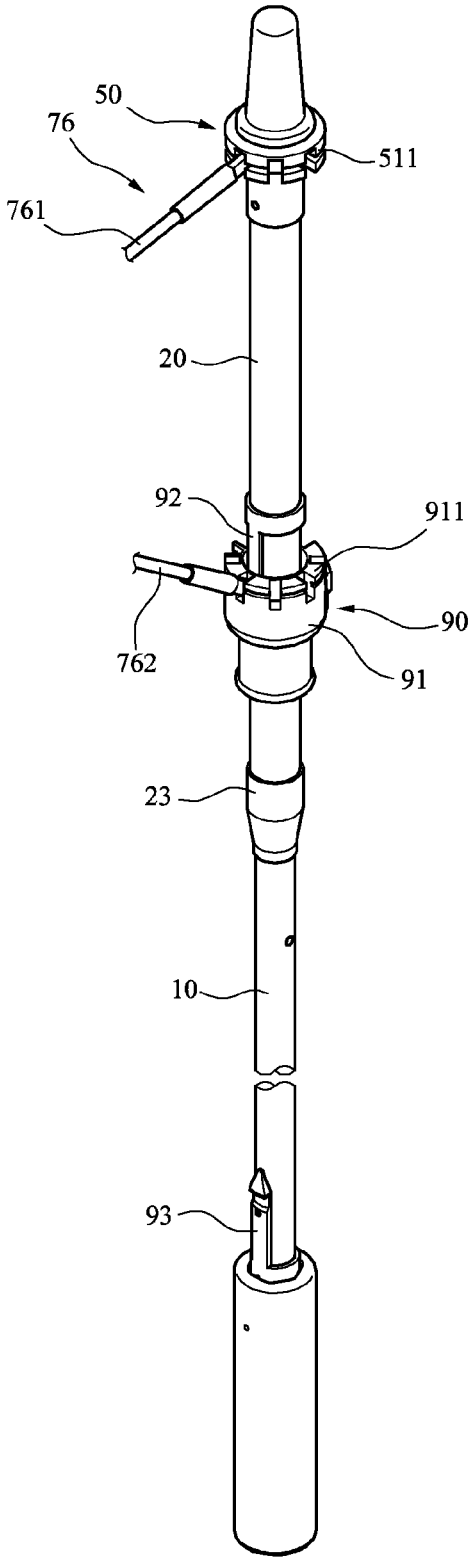
FIG. 13 is a perspective view of a portion of a frame of a manually opened umbrella incorporating the first preferred embodiment of the invention.
Figure 14:
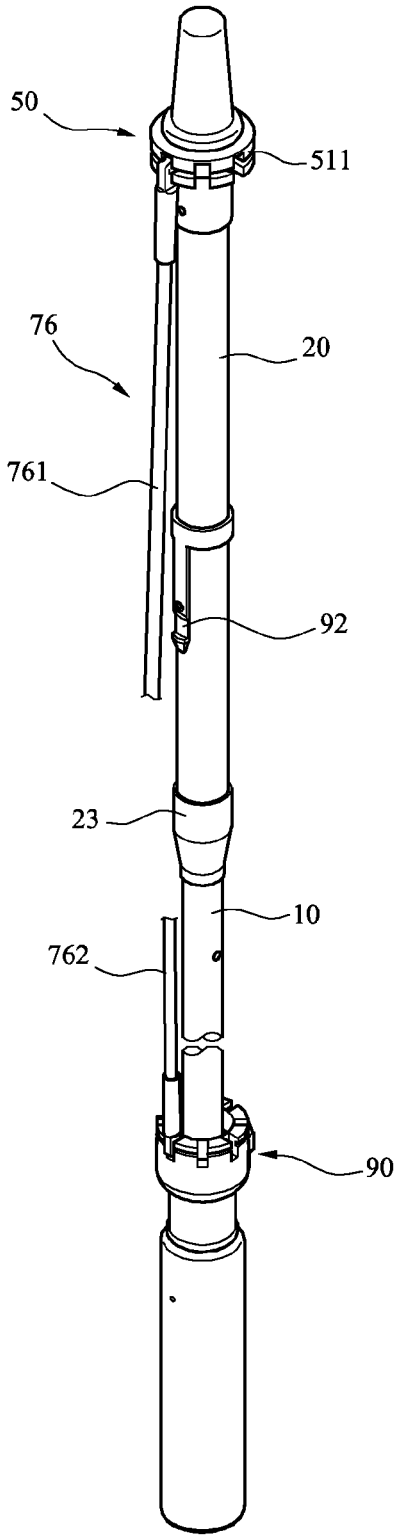
FIG. 14 is a view similar to FIG. 13 showing a closing operation of the manually opened umbrella.

Referring to FIGS. 10 to 12 in conjunction with FIGS. 1 to 9, the umbrella 1 is implemented as an automatic (i.e., auto-opening) umbrella and is discussed in detail below. A runner 70 is mounted on the outer tube 20. The runner 70 comprises a sleeve member 71 put on the outer tube 20, the sleeve member 71 including a lower locking member 711, an intermediate ring 72 provided on a top of the sleeve member 71, a compression spring 74 having a bottom secured to the top of the intermediate ring 72, and an upper ring 73 secured to a top of the compression spring 74. A rib assembly 75 comprises a plurality of ribs 751 with a canopy (not shown) secured thereon, each rib 751 having one end pivotably secured to the grommet 511, a plurality of stretchers 753 each having one end pivotably secured to the upper ring 73, and a plurality of interconnecting members 752 each having one end pivotably secured to the intermediate ring 72 and the other end pivotably secured to an intermediate portion of the stretcher 753. A stop ring 24 is provided on the outer tube 20 between the grommet 511 and the upper ring 73 (see FIGS. 10 and 12). The stop ring 24 is adapted to stop an upward sliding movement of the upper ring 73.

In this automatic umbrella embodiment, a locking device 80 is further provided on a lower portion of the inner tube 10 and comprises a lower handle 81, an upper socket 82, and a locking tab 83 disposed on an outer surface of the socket 82. A downward movement of the runner 70 means an upward movement of the inner tube 10. Thus, the inner tube 10 together with the moving mechanism 30 move upward to cause the upper member 31 to compress the spring 65 (see FIGS. 4 and 6) and also compress the spring 74. Thus, an upper portion of the inner tube 10 is retracted into the outer tube 20, and the locking member 711 is locked by the socket 82. As a result, the inner tube 10 and the outer tube 20 locked together.

A pressing of the locking tab 83 unlocks the locking member 711. Also, the inner tube 10 and the outer tube 20 are unlocked. Both the energized springs 74, 65 expand to push the outer tube 20 upward (see FIGS. 2, 5 and 7). Also, the runner 70 moves upward along the outer tube 20 until being stopped by the stop ring 24. As a result, the rib assembly 75 is fully extended, i.e., the umbrella 1 being open.

Referring to FIGS. 13 to 15B in conjunction with FIGS. 1 to 9, the umbrella is implemented as a manually open umbrella and is discussed in detail below. A runner 90 comprises an upper stop member 92 mounted on the outer tube 20, a sleeve member 91 put on the outer tube 20 and including a ring member 911 below the upper stop member 92, and a lower stop member 93 mounted on the inner tube 10. A rib assembly 76 comprises a plurality of ribs 761 with a canopy (not shown) secured thereon, each rib 761 having one end pivotably secured to the grommet 511, a plurality of stretchers 762 each having one end pivotably secured to the ring member 911 and the other end pivotably secured to an intermediate portion of the rib 761.

Figure 15A:
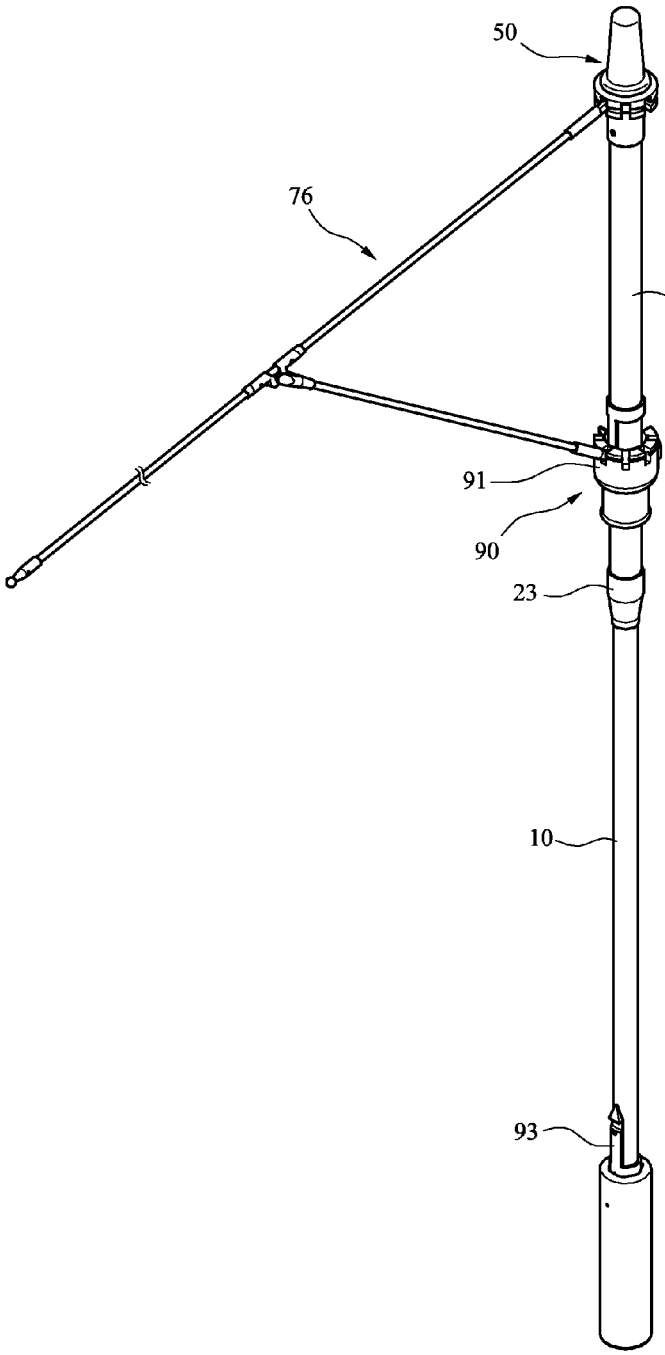
FIG. 15A is a view similar to FIG. 13 showing more portions of the umbrella frame.
Figure 15B:
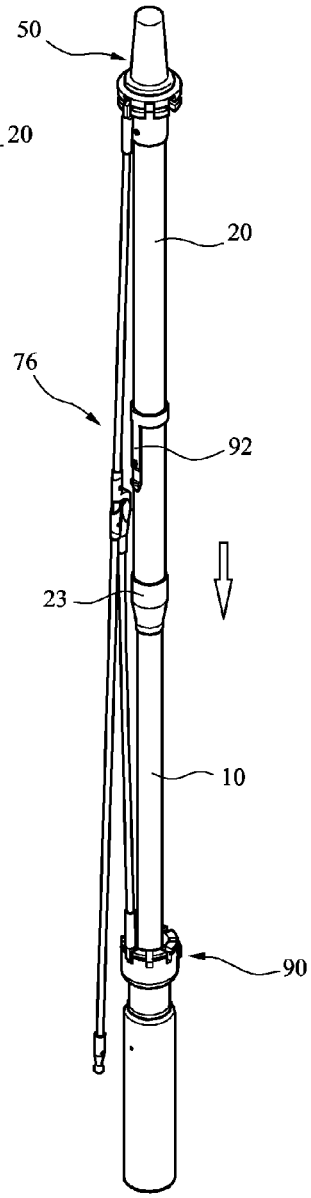
FIG. 15B is a view similar to FIG. 14 showing more portions of the umbrella frame.

An upward movement of the sleeve member 91 will be stopped by the upper stop member 92 in an opening operation of the umbrella (see FIG. 15A). To the contrary, a downward movement of the sleeve member 91 will be stopped by the lower stop member 93 in a closing operation of the umbrella (see FIG. 15B).

Figure 16:
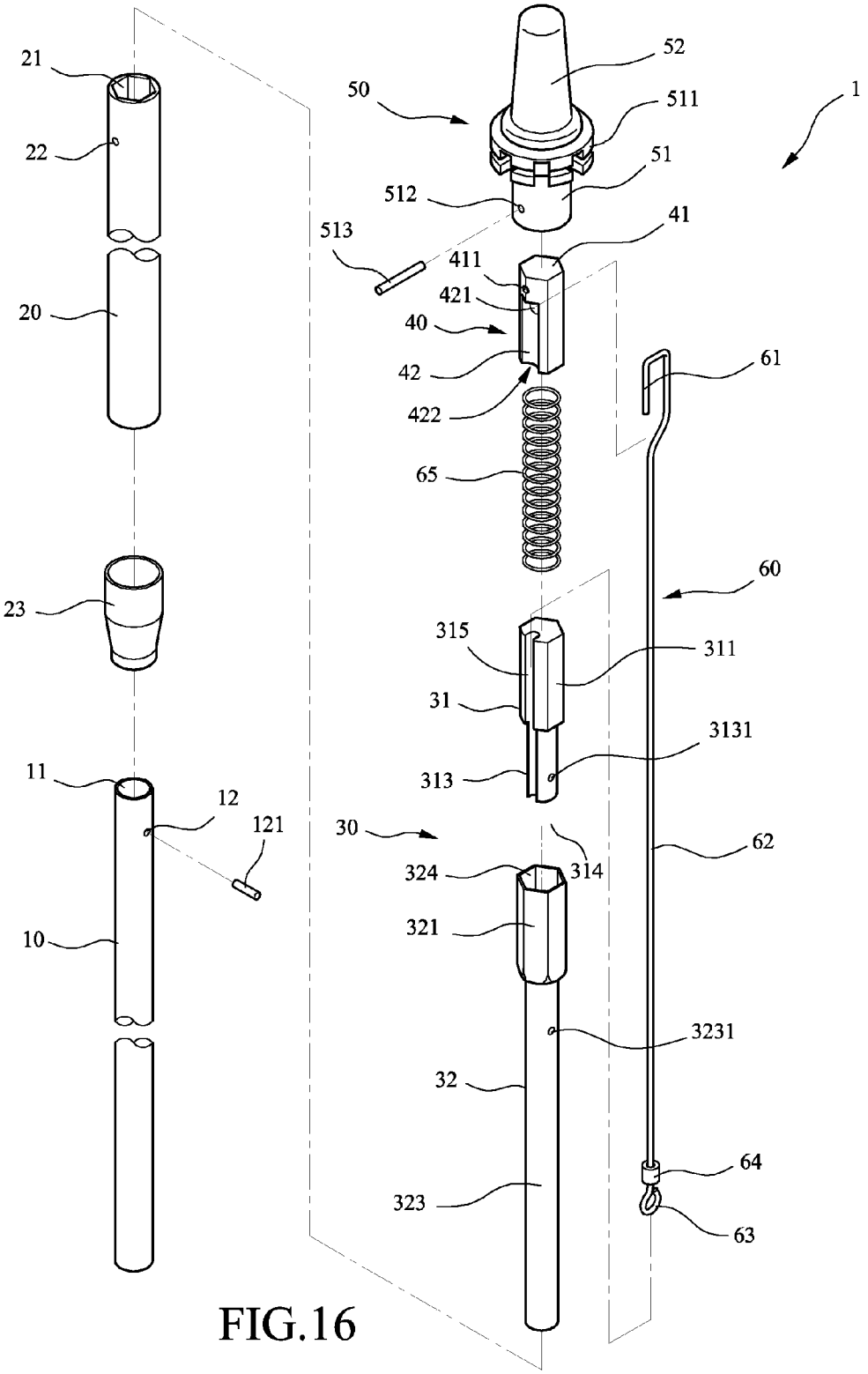
FIG. 16 is an exploded view of a shank and a thimble of a collapsible umbrella according to a second preferred embodiment of the invention.

Referring to FIG. 16, frame of a collapsible FRP umbrella 1 in accordance with a second preferred embodiment of the invention is shown. The characteristics of the second preferred embodiment are substantially the same as that of the first preferred embodiment except the following:

Each of the upper member 31 and the lower member 32 are a two-step diameter component. The upper member 31 comprises an upper part 311 and a lower part 313. Diameter of the upper part 311 is greater than that of the lower part 313. A longitudinal groove 315 is formed through outer surfaces of the upper and lower parts 311 and 313. A transverse aperture 3131 is formed through the lower part 313. The lower part 313 is cylindrical. A transverse aperture 3131 is formed through the lower part 313. The lower member 32 comprises an upper part 321 and a lower part 323. Diameter of the upper part 321 is greater than that of the lower part 323. A transverse aperture 3231 is formed through the lower part 323.

While the invention has been described in terms of preferred embodiments, those skilled in the art will recognize that the invention can be practiced with modifications within the spirit and scope of the appended claims.

What is claimed is:

1. An umbrella shank comprising:

an inner tube (10) formed of fiberglass-reinforced plastic (FRP) and including an interior (11);

an outer tube (20) formed of FRP and including an interior (21) having a polygonal section and an inner diameter greater than an outer diameter of the inner tube (10) so that the inner tube (10) is configured to insert into the interior (21) of the outer tube (20);

a moving mechanism (30) including an upper member (31) formed of FRP, and a lower member (32) formed of metal wherein the upper member (31) is a three-step diameter component and includes an upper part (311), an intermediate part (312), and a lower part (313); a longitudinal groove (315) is formed through outer surfaces of the upper, intermediate, and the lower parts (311, 312, 313); the lower member (32) is a three-step diameter component and includes an upper part (321), an intermediate part (322), and a lower part (323); the upper part (311) is a polygon, the intermediate part (312) is a polygon, and the lower part (313) is a cylinder; the upper part (321) is a hollow polygon; the intermediate part (322) is a hollow polygon; and the lower part (323) is a hollow cylinder; the upper part (311) is complementary to a polygonal interior (324) of the upper part (321) in shape, and the intermediate part (312) is complementary to a polygonal interior of the intermediate part (322) in shape; the lower part (313) is complementarily inserted into the lower part (323), the lower part (323) is inserted into the interior (11) of the inner tube (10), and the upper member (31) is partially disposed in the lower member (32) with both the upper part (311) and the upper part (321) disposed above the inner tube (10) and in the outer tube (20);

a fixing mechanism (40) disposed in an upper portion of the outer tube (20); and a linking mechanism (60) disposed in the outer tube (20) and including a rod (62) and a spring member (65) wherein the rod (62) has a top end secured to the fixing mechanism (40) and a bottom end passing through the longitudinal groove (315) to secure to a bottom of the lower part (313); and the spring member (65) is put on the rod (62) and is biased between the fixing mechanism (40) and tops of both the upper member (31) and the lower member (32).

2. The umbrella shank of claim 1, wherein the lower member (32) is formed of metal such as iron, steel, aluminum, aluminum alloy, or similar metal material.

3. The umbrella shank of claim 1, further comprising an aperture (12) formed on an upper portion of the inner tube (10), a transverse aperture (3131) formed through the lower part (313), and a transverse aperture (3231) formed through the lower part (323).

4. The umbrella shank of claim 1, wherein the interior (21) has a section of hexagon, the upper part (311) of the upper member (31) has a hexagonal section, the intermediate part (312) has a hexagonal section, the lower part (313) is a cylinder, a diameter of the upper part (311) is greater than that of the intermediate part (312), a diameter of the intermediate part (312) is greater than that of the lower part (313), the interior (324) in the upper part (321) of the lower member (32)

has a hexagonal section, the interior of the intermediate part (322) has a hexagonal section, the lower part (323) is a cylinder, a diameter of the upper part (321) is greater than that of the intermediate part (322), and a diameter of the intermediate part (322) is greater than that of the lower part (323).

5. The umbrella shank of claim 1, wherein each of the upper member (31) and the fixing mechanism (40) are formed of FRP.

6. The umbrella shank of claim 1, wherein the top end of the rod (62) is formed as an inverted U-shaped hook (61), the bottom end of the rod (62) is formed as a C-shaped hook (63), the inverted U-shaped hook (61) is secured to the fixing mechanism (40), and the C-shaped hook (63) is secured to a bottom of the lower member (32).

7. The umbrella shank of claim 6, further comprising a hollow, cylindrical buffer member (64) put on the rod (62) proximate the C-shaped hook (63).

8. An umbrella shank comprising:

an inner tube (10) formed of fiberglass-reinforced plastic (FRP) and including an interior (11);

an outer tube (20) formed of FRP and including an interior (21) having a polygonal section and an inner diameter greater than an outer diameter of the inner tube (10) so that the inner tube (10) is configured to insert into the interior (21) of the outer tube (20);

a moving mechanism (30) including an upper member (31) formed of FRP, and a lower member (32) formed of metal wherein the upper member (31) is a two-step diameter component and includes an upper part (311) and a lower part (313); a longitudinal groove (315) is formed through outer surfaces of the upper and lower parts (311 and 313); the lower member (32) is a two-step diameter component and includes an upper part (321) and a lower part (323); the upper part (311) is a polygon and the lower part (313) is a cylinder; the upper part (321) is a hollow polygon and the lower part (323) is a hollow cylinder; the upper part (311) is complementary to a polygonal interior (324) of the upper part (321) in shape; the lower part (313) is complementarily inserted into the lower part (323), the lower part (323) is inserted into the interior (11) of the inner tube (10), and the upper member (31) is partially disposed in the lower member (32) with both the upper part (311) and the upper part (321) disposed above the inner tube (10) and in the outer tube (20);

a fixing mechanism (40) disposed in an upper portion of the outer tube (20); and a linking mechanism (60) disposed in the outer tube (20) and including a rod (62) and a spring member (65) wherein the rod (62) has a top end secured to the fixing mechanism (40) and a bottom end passing through the longitudinal groove (315) to secure to a bottom of the lower part (313); and the spring member (65) is put on the rod (62) and is biased between the fixing mechanism (40) and tops of both the upper member (31) and the lower member (32).

9. The umbrella shank of claim 8, wherein the lower member (32) is formed of metal such as iron, steel, aluminum, aluminum alloy, or similar metal material.

10. The umbrella shank of claim 8, further comprising an aperture (12) formed on an upper portion of the inner tube (10), a transverse aperture (3131) formed through the lower part (313), and a transverse aperture (3231) formed through the lower part (323).

11. The umbrella shank of claim 8, wherein the upper part (311) of the upper member (31) has a hexagonal section, the lower part (313) is a cylinder, a diameter of the upper part (311) is greater than that of the lower part (313), the interior (324) in the upper part (321) of the lower member (32) has a hexagonal section, the lower part (323) is a cylinder, and a diameter of the upper part (321) is greater than that of the lower part (323).

12. The umbrella shank of claim 8, wherein each of the upper member (31) and the fixing mechanism (40) are formed of FRP.

13. The umbrella shank of claim 8, wherein the top end of the rod (62) is formed as an inverted U-shaped hook (61), the bottom end of the rod (62) is formed as a C-shaped hook (63), the inverted U-shaped hook (61) is secured to the fixing mechanism (40), and the C-shaped hook (63) is secured to a bottom of the lower member (32).

14. The umbrella shank of claim 12, further comprising a hollow, cylindrical buffer member (64) put on the rod (62) proximate the C-shaped hook (63).

* * * * *